US009523545B1

(12) United States Patent
Weller et al.

(10) Patent No.: US 9,523,545 B1
(45) Date of Patent: Dec. 20, 2016

(54) WEAPON LOADING SYSTEM

(71) Applicants: Richard Weller, Bakersfield, CA (US); Michael Weller, Bakersfield, CA (US)

(72) Inventors: Richard Weller, Bakersfield, CA (US); Michael Weller, Bakersfield, CA (US)

( * ) Notice: Subject to any disclaimer, the term of this patent is extended or adjusted under 35 U.S.C. 154(b) by 0 days.

(21) Appl. No.: 15/052,974

(22) Filed: Feb. 25, 2016

(51) Int. Cl.
*F41A 9/52* (2006.01)
*F41A 9/38* (2006.01)
*F41C 3/00* (2006.01)

(52) U.S. Cl.
CPC .. *F41A 9/38* (2013.01); *F41C 3/00* (2013.01)

(58) Field of Classification Search
CPC ..... F41A 35/00
USPC ... 42/90, 106, 108; 89/45, 1.4, 1.1; 224/196, 224/197; 206/3
See application file for complete search history.

(56) References Cited

U.S. PATENT DOCUMENTS

| | | | | |
|---|---|---|---|---|
| 4,873,777 | A | 10/1989 | Southard | |
| 7,584,861 | B2 | 9/2009 | Werner | |
| 7,614,534 | B2 * | 11/2009 | Veo | G07F 11/16 224/196 |
| 8,438,774 | B2 | 5/2013 | Sharp et al. | |
| 2011/0174847 | A1 | 7/2011 | Crye | |
| 2013/0104440 | A1 * | 5/2013 | Addis | F41A 17/38 42/90 |
| 2014/0360071 | A1 | 12/2014 | Savitsky et al. | |
| 2015/0121734 | A1 | 5/2015 | Kresser | |
| 2015/0219413 | A1 * | 8/2015 | Karimullah | F41A 9/01 89/132 |

* cited by examiner

*Primary Examiner* — J. Woodrow Eldred

(57) ABSTRACT

A weapon loading system includes a handgun that has a slide and a magazine. A panel is provided and the panel may be worn. A holder is hingedly coupled to the panel and the magazine is removably coupled to the holder. The handgun is selectively positioned on the magazine to facilitate loading the magazine into the handgun with one hand. A block is coupled to the panel. The handgun selectively engages the block when the magazine is loaded into the handgun. The block engages the slide such that the slide is racked when the handgun engages the block. Thus, the handgun may be cocked with one hand.

8 Claims, 5 Drawing Sheets

WEAPON LOADING SYSTEM

BACKGROUND OF THE DISCLOSURE

Field of the Disclosure

The disclosure relates to loading devices and more particularly pertains to a new loading device for loading and cocking a semi-automatic handgun with one hand.

SUMMARY OF THE DISCLOSURE

An embodiment of the disclosure meets the needs presented above by generally comprising a handgun that has a slide and a magazine. A panel is provided and the panel may be worn. A holder is hingedly coupled to the panel and the magazine is removably coupled to the holder. The handgun is selectively positioned on the magazine to facilitate loading the magazine into the handgun with one hand. A block is coupled to the panel. The handgun selectively engages the block when the magazine is loaded into the handgun. The block engages the slide such that the slide is racked when the handgun engages the block. Thus, the handgun may be cocked with one hand.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
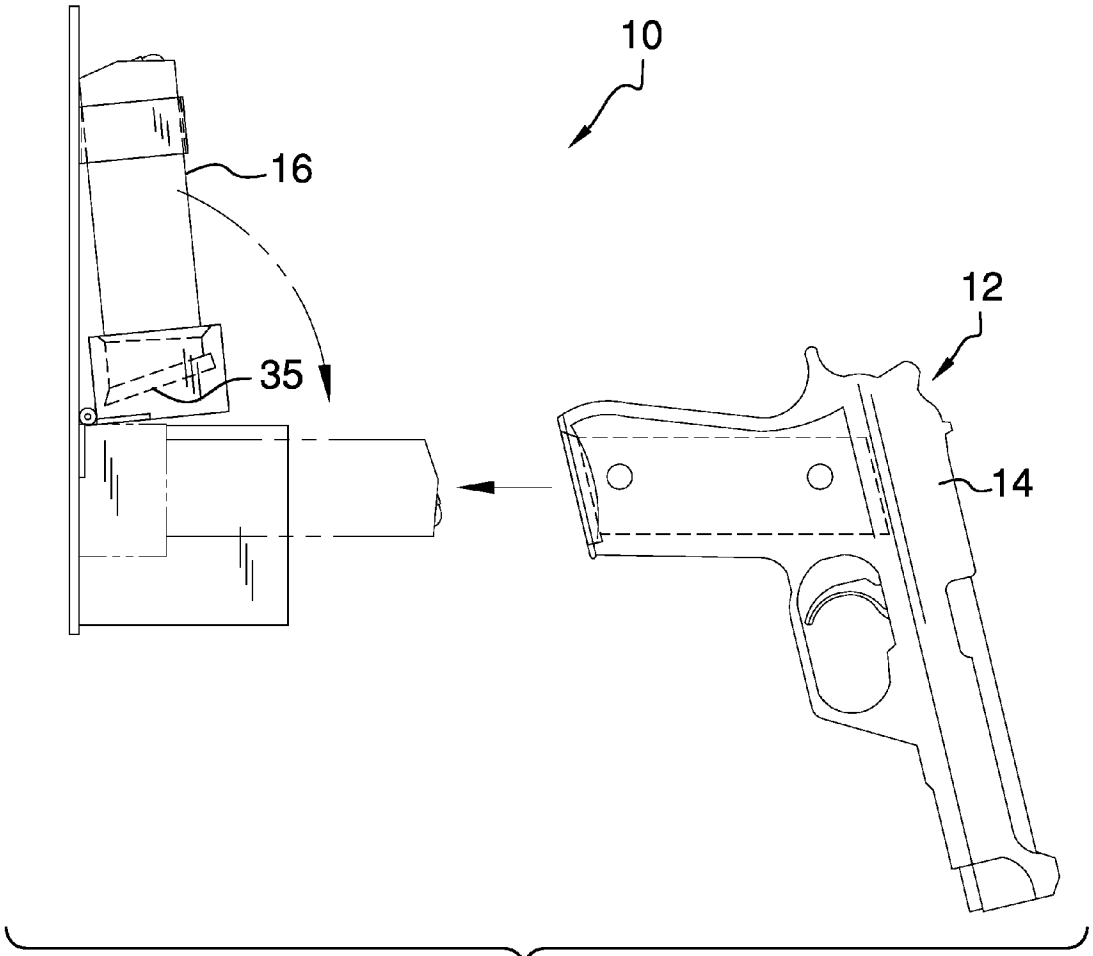
FIG. 1 is a right side perspective view of a weapon loading system according to an embodiment of the disclosure.
Figure 2:
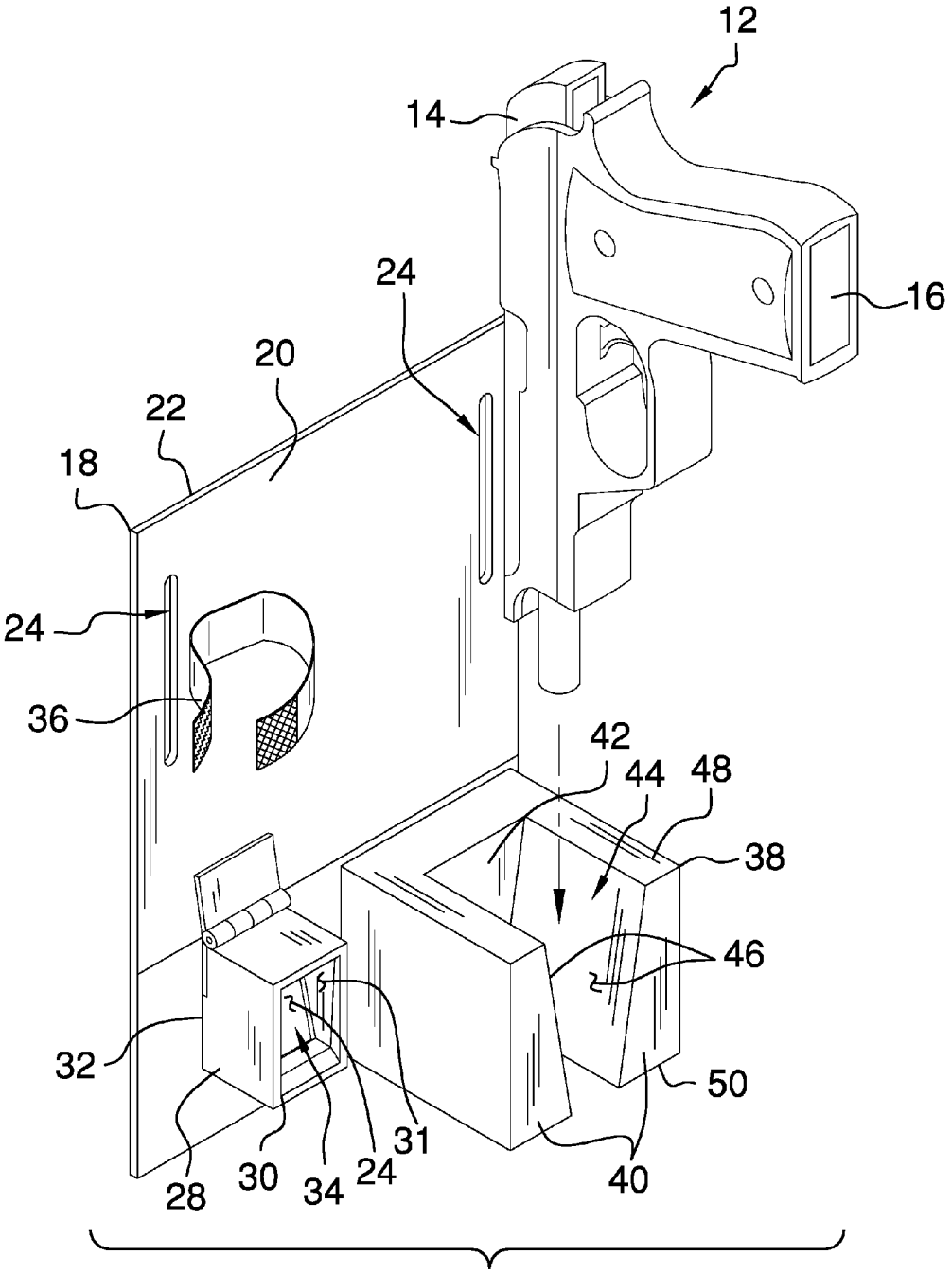
FIG. 2 is a front perspective view of an embodiment of the disclosure.
Figure 3:
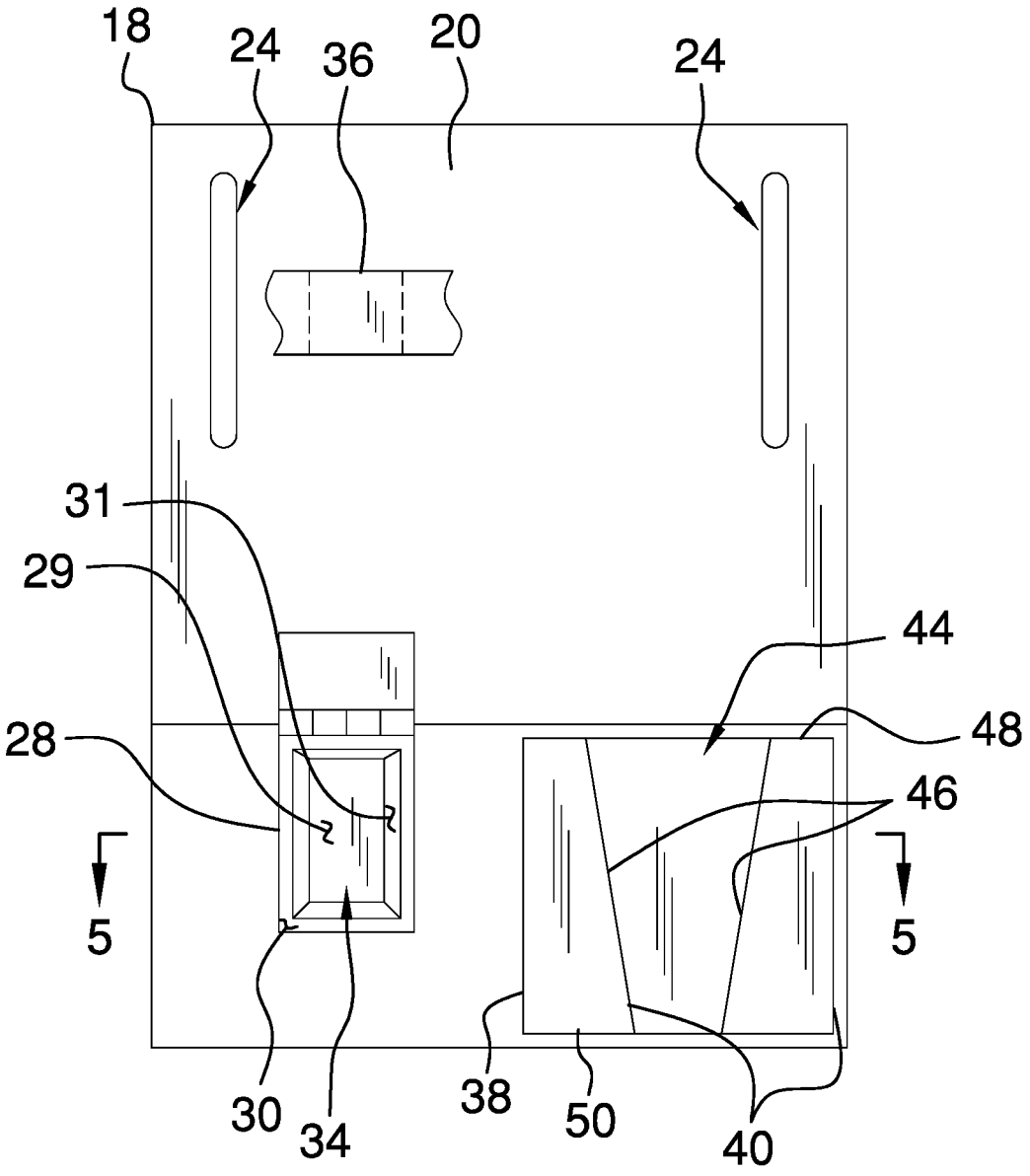
FIG. 3 is a front view of an embodiment of the disclosure.
Figure 4:
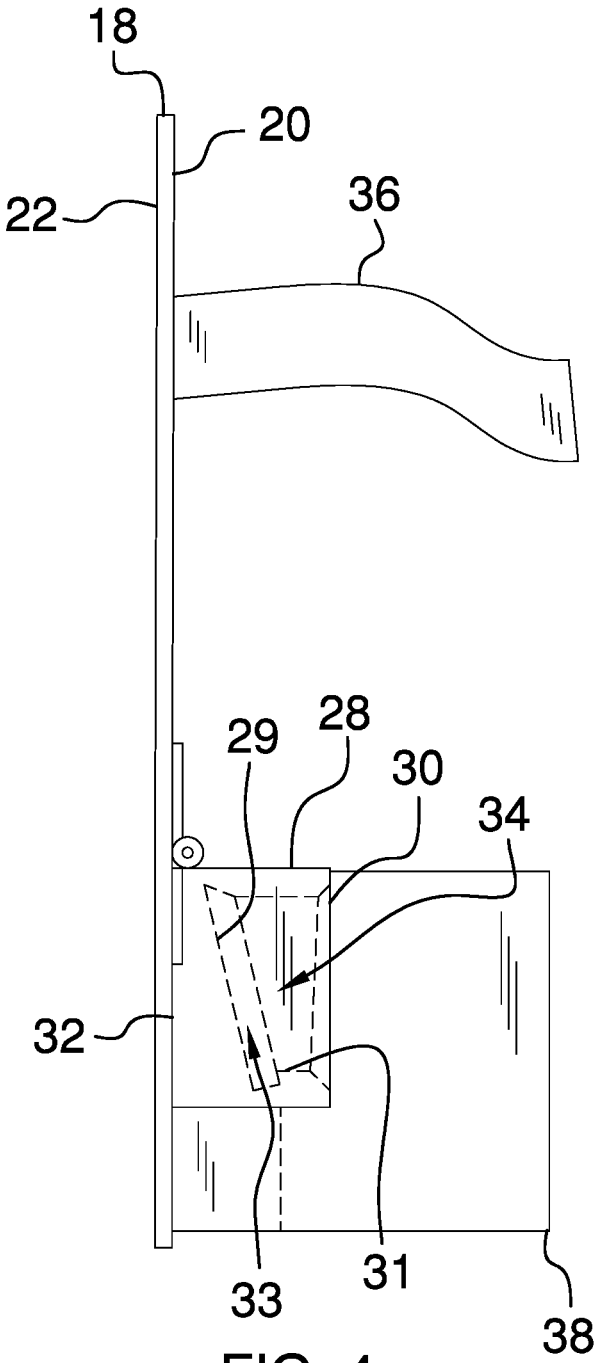
FIG. 4 is a right side view of an embodiment of the disclosure.
Figure 5:
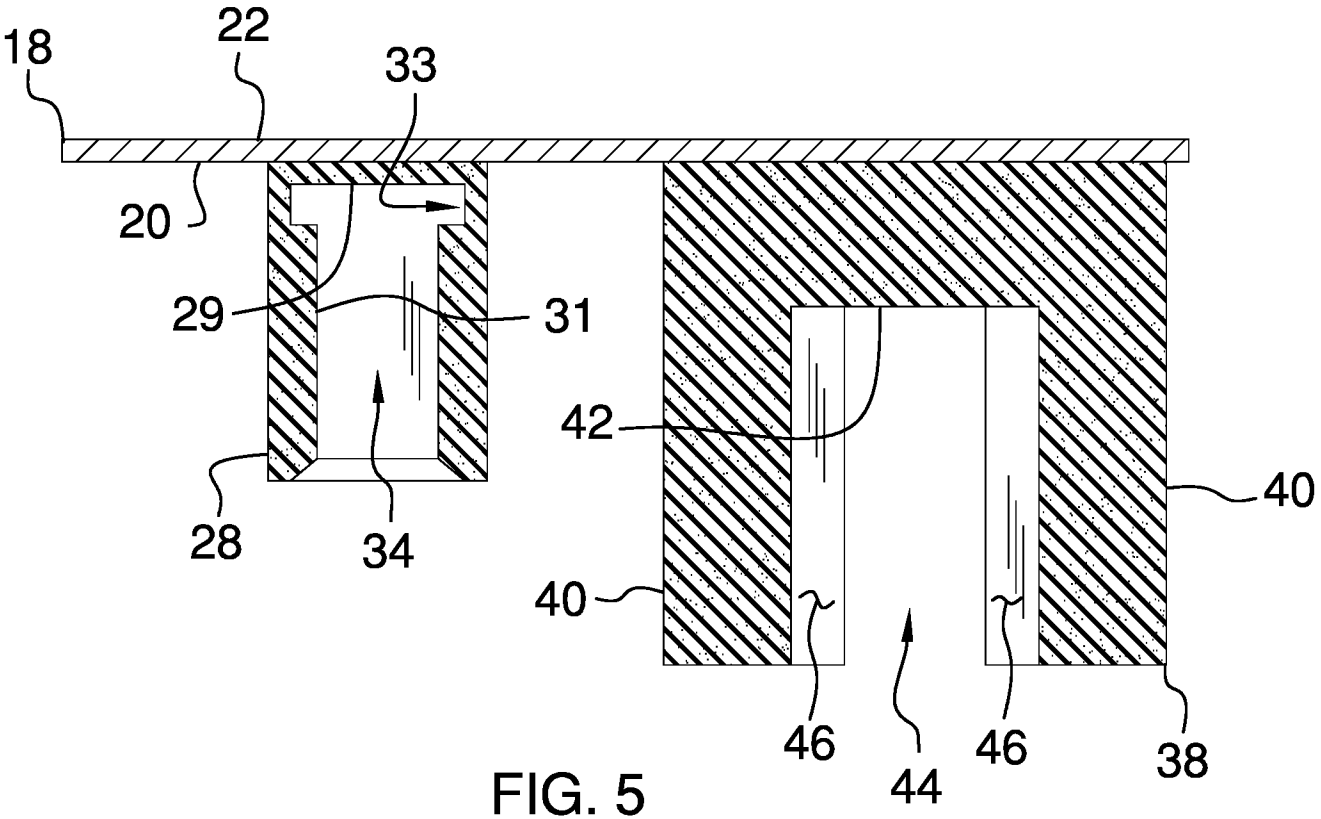
FIG. 5 is a cross sectional view taken along line 5-5 of FIG. 3 of an embodiment of the disclosure.

With reference now to the drawings, and in particular to FIGS. 1 through 5 thereof, a new loading device embodying the principles and concepts of an embodiment of the disclosure and generally designated by the reference numeral 10 will be described.

As best illustrated in FIGS. 1 through 5, the weapon loading system 10 generally comprises a handgun 12 that has a slide 14 and a magazine 16. A panel 18 is provided and the panel 18 may be worn. The panel 18 has a first side 20 and a second side 22. The panel 18 has a pair of slots 24 extending through the first side 20 and the second side 22. Each of the slots 24 may have a belt extended therethrough thereby facilitating the panel 18 to be worn. The panel 18 may be worn by law enforcement or the like and the handgun 12 may comprise a semi-automatic handgun or the like.

A holder 28 is hingedly coupled to the panel 18. The magazine 16 is removably coupled to the holder 28. The handgun 12 is selectively positioned on the magazine 16. Thus, the holder 28 facilitates loading the magazine 16 into the handgun 12 with one hand. The handgun 12 may be loaded with one hand if a user has an injured arm or has limited use of an arm.

The holder 28 has an outwardly facing surface 30 and a rearwardly facing surface 32. The outwardly facing surface 30 has a well 34 extending inwardly toward the rearwardly facing surface 32. The rearwardly facing surface 32 abuts the first side 20 of the panel 18 when the holder 28 is positioned in a deployed position. The rearwardly facing surface 32 is spaced from the first side 20 when the holder 28 is positioned in a stored position.

The well 34 has a lower bounding surface 29 and a lateral bounding surface 31. The lower bounding surface 29 may be oriented at an angle with respect to the rearwardly facing surface 32. Additionally, the lower bounding surface 29 may extend outwardly beyond the lateral bounding surface 31 to define a chamber 33 in the well 34. The chamber 33 may receive a bottom side 35 of the magazine 16. Thus, the magazine 16 is frictionally retained in the holder 28.

The well 34 insertably receives the magazine 16. The magazine 16 is positioned to extend laterally away from the panel 18 when the holder 28 is in the deployed position. The magazine 16 extends upwardly along the first side 20 when the holder 28 is positioned in the stored position. A strap 36 is coupled to the first side 20 and the strap 36 is aligned with the holder 28. The strap 36 is matable to itself. The strap 36 selectively engages the magazine 16 when the holder 28 is in the stored position. Thus, the holder 28 is retained in the stored position.

A block 38 is coupled to the panel 18. The handgun 12 selectively engages the block 38 when the magazine 16 is loaded into the handgun 12. The block 38 engages the slide 14 such that the slide 14 is racked when the handgun 12 engages the block 38. Thus, the handgun 12 may be cocked with one hand. The block 38 has a pair of walls 40 extending away from a base 42. The base 42 is coupled to the first side 20 of the panel 18.

The walls 40 are spaced apart from each other to define a space 44 between the walls 40. Each of the walls 40 has in inwardly facing surface 46 extending between a top edge 48 and a bottom edge 50. The inwardly facing surface 46 corresponding to each of the walls 40 angles inwardly between the top edge 48 and the bottom edge 50. Thus, the space 44 tapers inwardly between the top edge 48 and the bottom edge 50 corresponding to each of the walls 40.

The handgun 12 is selectively positioned in the space 44 when the magazine 16 is loaded into the handgun 12. The handgun 12 is urged downwardly in the space 44. The inwardly facing surface 46 corresponding to each of the walls 40 frictionally engages the slide 14. Thus, the slide 14 is racked when the handgun 12 is urged downwardly in the space 44. The block 38 may be comprised of a resiliently compressible material thereby enhancing gripping the slide 14.

In use, the magazine 16 is positioned in the holder 28 and the holder 28 is positioned in the stored position. The strap 36 is coupled around the magazine 16 to retain the holder 28 in the stored position. The strap 36 is removed from the magazine 16 to position the holder 28 in the deployed position when the handgun 12 needs to be loaded. The handgun 12 is manipulated to insert the magazine 16 into the handgun 12. The handgun 12 is positioned in the block 38 and the handgun 12 is urged downwarldy in the space 44. The block 38 racks the slide 16 thereby facilitating the handgun 12 to be loaded and ready to fire.

With respect to the above description then, it is to be realized that the optimum dimensional relationships for the parts of an embodiment enabled by the disclosure, to include variations in size, materials, shape, form, function and manner of operation, system and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A weapon loading system facilitating one handed reloading of a weapon, said system comprising:

a handgun having a slide and a magazine;

a panel being configured to be worn;

a holder being hingedly coupled to said panel, said magazine being removably coupled to said holder, said handgun being selectively positioned on said magazine wherein said holder is configured to facilitate loading the magazine into the handgun with one hand; and a block being coupled to said panel, said handgun selectively engaging said block when said magazine is loaded into said handgun, said block engaging said slide such that said slide is racked when said handgun engages said block wherein said handgun is configured to be cocked with one hand.

2. The system according to claim 1, wherein said panel has a first side and a second side, said panel having a pair of slots extending through said first side and said second side, each of said slots being configured to have a belt extended therethrough thereby facilitating said panel to be worn.

3. The system according to claim 1, wherein said holder has an outwardly facing surface and a rearwardly facing surface, said outwardly facing surface having a well extending inwardly toward said rearwardly facing surface, said rearwardly facing surface abutting a first side of said panel said holder is positioned in a deployed position, said rearwardly facing surface being spaced from said first side when said holder is positioned in a stored position.

4. The system according to claim 3, wherein said well insertably receives said magazine such that said magazine is positioned to extends laterally away from said panel when said holder is in said deployed position, said magazine extending upwardly along said first side when said holder is positioned in said stored position.

5. The system according to claim 4, further comprising a strap being coupled to said first side, said strap being matable to itself, said strap selectively engaging said magazine when said holder is in said stored position thereby retaining said holder in said stored position.

6. The system according to claim 1, wherein said block has a pair of walls extending away from a base, said walls being spaced apart from each other to define a space between said walls, said base being coupled to a first side of said panel, each of said walls having in inwardly facing surface extending between a top edge and a bottom edge.

7. The system according to claim 6, wherein said inwardly facing surface corresponding to each of said walls angles inwardly between said top edge and said bottom edge such that said space tapers inwardly between said top edge and said bottom edge corresponding to each of said walls, said handgun being positioned in said space and being urged downwardly in said space having said inwardly facing surface corresponding to each of said walls frictionally engaging said slide such that said slide is racked when said handgun is urged downwardly in said space.

8. A weapon loading system facilitating one handed reloading of a weapon, said system comprising:

a handgun having a slide and a magazine;

a panel being configured to be worn, said panel having a first side and a second side, said panel having a pair of slots extending through said first side and said second side, each of said slots being configured to have a belt extended therethrough thereby facilitating said panel to be worn;

a holder being hingedly coupled to said panel, said magazine being removably coupled to said holder, said handgun being selectively positioned on said magazine wherein said holder is configured to facilitate loading the magazine into the handgun with one hand, said holder having an outwardly facing surface and a rearwardly facing surface, said outwardly facing surface having a well extending inwardly toward said rearwardly facing surface, said rearwardly facing surface abutting said first side of said panel said holder is positioned in a deployed position, said rearwardly facing surface being spaced from said first side when said holder is positioned in a stored position, said well insertably receiving said magazine such that said magazine is positioned to extends laterally away from said panel when said holder is in said deployed position, said magazine extending upwardly along said first side when said holder is positioned in said stored position;

a strap being coupled to said first side, said strap being matable to itself, said strap selectively engaging said magazine when said holder is in said stored position thereby retaining said holder in said stored position;

a block being coupled to said panel, said handgun selectively engaging said block when said magazine is loaded into said handgun, said block engaging said slide such that said slide is racked when said handgun engages said block wherein said handgun is configured to be cocked with one hand, said block having a pair of walls extending away from a base, said base being coupled to said first side of said panel, said walls being spaced apart from each other to define a space between said walls, each of said walls having in inwardly facing surface extending between a top edge and a bottom edge, said inwardly facing surface corresponding to each of said walls angling inwardly between said top edge and said bottom edge such that said space tapers inwardly between said top edge and said bottom edge corresponding to each of said walls, said handgun being positioned in said space and being urged downwardly in said space having said inwardly facing surface corresponding to each of said walls frictionally engaging said slide such that said slide is racked when said handgun is urged downwardly in said space.

* * * * *